US011702308B2

(12) United States Patent
Tachibana et al.

(10) Patent No.: US 11,702,308 B2
(45) Date of Patent: Jul. 18, 2023

(54) SHEET PROCESSING MACHINE AND SHEET PROCESSING METHOD

(71) Applicant: Glory Ltd., Himeji (JP)

(72) Inventors: Yusaku Tachibana, Himeji (JP); Takeshi Yokawa, Himeji (JP); Yuya Kataoka, Himeji (JP); Keisuke Nada, Himeji (JP); Daiki Tanaka, Himeji (JP)

(73) Assignee: GLORY LTD., Himeji (JP)

( * ) Notice: Subject to any disclaimer, the term of this patent is extended or adjusted under 35 U.S.C. 154(b) by 0 days.

(21) Appl. No.: 17/679,092

(22) Filed: Feb. 24, 2022

(65) Prior Publication Data

US 2022/0177250 A1 Jun. 9, 2022

Related U.S. Application Data

(63) Continuation of application No. 17/023,369, filed on Sep. 17, 2020, now Pat. No. 11,292,686.

(30) Foreign Application Priority Data

Sep. 20, 2019 (JP) ..... 2019-171938

(51) Int. Cl.
*B65H 29/00* (2006.01)
*B65H 43/00* (2006.01)

(52) U.S. Cl.
CPC ..... *B65H 29/006* (2013.01); *B65H 43/00* (2013.01); *B65H 2301/4128* (2013.01);
(Continued)

(58) Field of Classification Search
CPC ..... B65H 29/006; B65H 43/00; B65H 2301/4128; B65H 2301/4143;
(Continued)

(56) References Cited

U.S. PATENT DOCUMENTS 6,715,753 B1 4/2004 Conca et al.
7,654,485 B2 * 2/2010 Rossel ..... B65H 5/28 271/216
(Continued)

FOREIGN PATENT DOCUMENTS

EP 0795842 A2 9/1997
EP 2579223 A1 4/2013
(Continued)

OTHER PUBLICATIONS

Extended European search report dated Mar. 3, 2021, in corresponding European patent Application No. 20196383.2, 9 pages.

*Primary Examiner* — Jeremy R Severson
(74) *Attorney, Agent, or Firm* — Xsensus LLP

(57) ABSTRACT

A sheet processing machine stores sheets transported by a transport unit. The sheet processing machine includes: a reel on which a first end side of a tape is wound; a first stepper motor that rotates the reel about a rotation axis of the reel; a drum configured to wind up a second end side of the tape together with the sheets to form a winding body together with the tape and the sheets; a second stepper motor that rotates the drum about a rotation axis of the drum; and circuitry configured to change an interval between the sheets wound on the drum by controlling a rotation of the first stepper motor and the second stepper motor based on a parameter indicating a condition of the winding body.

15 Claims, 7 Drawing Sheets

(52) U.S. Cl.
CPC ..... *B65H 2301/4143* (2013.01); *B65H 2301/4191* (2013.01); *B65H 2301/4452* (2013.01); *B65H 2511/11* (2013.01); *B65H 2511/30* (2013.01); *B65H 2515/10* (2013.01); *B65H 2515/32* (2013.01); *B65H 2555/26* (2013.01); *B65H 2701/1912* (2013.01)

(58) Field of Classification Search
CPC ..... B65H 2301/4191; B65H 2511/32; B65H 2301/4452; B65H 2511/31
See application file for complete search history.

(56) References Cited

U.S. PATENT DOCUMENTS

| | | | | |
|---|---|---|---|---|
| 11,292,686 | B2 * | 4/2022 | Tachibana ..... | B65H 29/006 |
| 2012/0241283 | A1 | 9/2012 | Sakamoto et al. | |
| 2013/0081922 | A1 | 4/2013 | Amo | |

FOREIGN PATENT DOCUMENTS

| | | | |
|---|---|---|---|
| JP | 2012-198764 | A | 10/2012 |
| JP | 2016-003095 | A | 1/2016 |

* cited by examiner

SHEET PROCESSING MACHINE AND SHEET PROCESSING METHOD

CROSS-REFERENCE TO RELATED APPLICATIONS

This application is a continuation of U.S. application Ser. No. 17/023,369, filed Sep. 17, 2020, which is entitled to (or claims) the benefit of Japanese Patent Application No. 2019-171938, filed on Sep. 20, 2019, the disclosure of which including the specification, drawings and abstract are incorporated herein by reference in its entirety.

TECHNICAL FIELD

The present disclosure relates to a sheet processing machine and a sheet processing method.

BACKGROUND ART

As illustrated in PTL 1 for example, conventionally, a sheet processing machine comprising a wind-up type storage unit in which sheets are stored in a state of being wound up by a drum together with a tape.

CITATION LIST

Patent Literature

PTL1
Japanese Patent Application Laid-Open No. 2012-198764

SUMMARY

Technical Problem

Conventionally, control of a winding state of the storage unit has been required.

It is an object of the present disclosure to provide a technique for controlling the winding state of the storage unit.

Solution to Problem

An exemplary solution includes a sheet processing machine according to the present disclosure that stores sheets transported by a transport unit. The sheet processing machine includes a reel on which a first end side of a tape is wound; a first stepper motor that rotates the reel about a rotation axis of the reel; a drum configured to wind up a second end side of the tape together with the sheets to form a winding body together with the tape and the sheets; a second stepper motor configured to rotate the drum about a rotation axis of the drum; and circuitry configured to change an interval between the sheets wound on the drum by controlling a rotation of the first stepper motor and the second stepper motor based on a parameter indicating a condition of the winding body.

Advantageous Effects

According to the present disclosure, the winding state of the storage unit can be controlled.

DESCRIPTION OF EMBODIMENTS

Hereinafter, embodiments of the present disclosure will be described in detail with reference to the accompanying drawings. In the following description, as a representative example of a sheet processing machine according to the present disclosure, a banknote processing machine for processing banknotes as sheets will be described. Note that the sheets are not limited to the banknotes, and may be gift certificates, securities, voting sheets, and/or the like. The sheets are not limited to things made of paper as a material, things formed by a material other than the paper into a sheet shape or things formed by sticking the material other than the paper and paper into the sheet shape. The material other than the paper is, for example, a resin.

Figure 1:
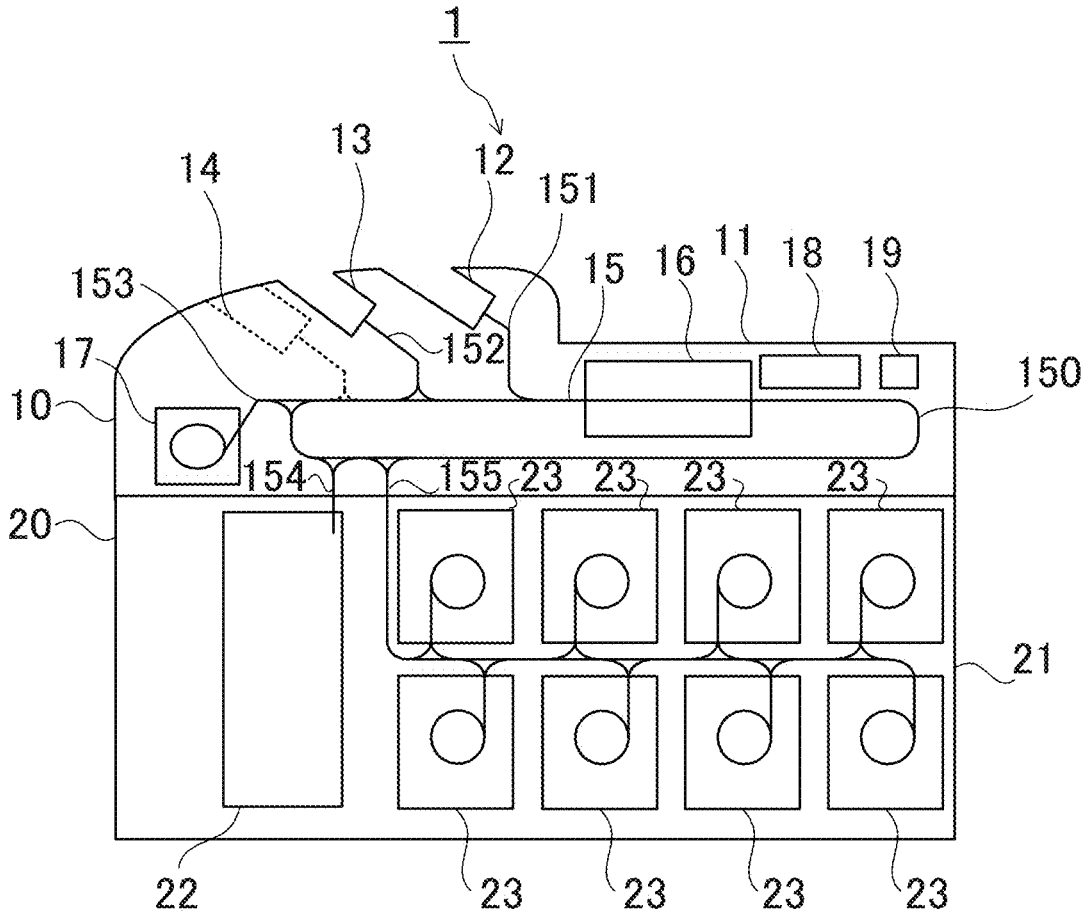
FIG. 1 is a schematic diagram of a banknote processing machine according to Embodiment.

FIG. 1 is a schematic diagram of a banknote processing machine 1 according to Embodiment. The banknote processing machine 1 illustrated in FIG. 1 is a banknote depositing and dispensing machine for depositing and dispensing the banknotes. In the following description, the term "front" of the banknote processing machine 1 means a side of an operator who performs at least one of the operation of inserting and discharging the banknotes via a depositing unit or a dispensing unit, and the term "rear" of the banknote processing machine means the opposite side of "front". In other words, the "front" of the banknote processing machine means the side on which an opening for performing at least one of the operation of inserting and discharging the banknotes is provided. The term "left" of the banknote processing machine means a left side as viewed from the operator facing the opening, and the term "right" of the banknote processing machine means a right side as viewed from the operator facing the opening. While the term "unit" is used in the present disclosure, it is done so in the context of the units being physical structures, and thus "unit" and "structure" may be used synonymously herein.

The banknote processing machine 1 comprises a processing unit 10 and a storage 20 provided below the processing unit 10.

The processing unit 10 has an upper housing 11. A depositing unit 12 on which the banknotes to be deposited are placed and a dispensing unit 13 on which the banknotes to be dispensed are placed are disposed in front of the upper portion of the upper housing 11. In the upper housing 11, a second dispensing unit 14 configured similarly to the dispensing unit 13 may be disposed next to the dispensing unit 13, if necessary. Inside the upper housing 11, a transport unit 15 for transporting the banknotes, a recognition unit 16 for recognizing the banknotes, and a temporary storage 17 for temporarily storing the banknotes are disposed. Inside the upper housing 11, a control unit 18 for controlling each unit of the banknote processing machine 1, and a memory unit 19 are disposed.

The depositing unit 12 is configured to feed out the banknotes one by one toward the transport unit 15. The dispensing unit 13 is configured to accumulate the banknotes transported by the transport unit 15.

The transport unit 15 is a transporting device that transports the banknotes at a predetermined transport speed. The transport unit 15 can be configured by, for example, any one of or a combination of a belt mechanism and a roller mechanism. The transport unit 15 comprises a loop-shaped transport path 150 that transports the banknotes in a loop shape, and a first diverter path 151, a second diverter path 152, a third diverter path 153, a fourth diverter path 154, and a fifth diverter path 155 that diverge from the loop-shaped transport path 150.

The first diverter path 151 connects the loop-shaped transport path 150 and the depositing unit 12. The second diverter path 152 connects the loop-shaped transport path 150 and the dispensing unit 13. The third diverter path 153 connects the loop-shaped transport path 150 and the temporary storage 17 to be described later. The fourth diverter path 154 connects the loop-shaped transport path 150 and a stacking type storage 22 to be described later. The fifth diverter path 155 connects the loop-shaped transport path 150 and a plurality of the winding type storage 23 to be described later. At a portion where each diverter path diverges from the loop-shaped transport path 150, a diverter claw (not illustrated) for distributing the banknotes is disposed. In the case where the second dispensing unit 14 is disposed, another diverter path for connecting the loop-shaped transport path 150 and the second dispensing unit 14 is provided.

The recognition unit 16 is an recognizing device that reads information of the banknotes and recognizing the banknotes. The recognition unit 16 comprises sensors such as an image sensor, an optical sensor, and a magnetic sensor, and recognizes the banknote information such as the authenticity, the denomination, the fitness, and the serial number of the banknotes transported by the transport unit 15.

The serial number is a unique number attached to each banknote, for example, a 10-digit character string of a combination of alphabets and numbers. The recognition unit 16 recognizes each of the 10-digit characters constituting the serial number.

The temporary storage 17 is a storage device that temporarily stores the banknotes. The temporary storage 17 can take in and store the banknotes one by one, and feed out the stored banknotes one by one.

The temporary storage 17 is a type of a winding type storage in which a plurality of the banknotes is stored in a state of being wound around a rotating body. The temporary storage 17 comprises a banknote storage unit 40 (see FIG. 2 and FIG. 3) which will be described later. The temporary storage 17 may be a stacking type storage in which a plurality of the banknotes is stored in a stacked state.

The control unit 18 is configured to control the operation of the banknote processing machine 1. The memory unit 19 is, for example, a nonvolatile memory. The control unit 18 is configured to perform various types of processing using the information memorized in the memory unit 19. The control unit 18 controls the transport unit 15 so that the banknotes are transported between the depositing unit 12, the dispensing unit 13, the temporary storage 17, the stacking type storage 22, and the winding type storage 23.

Storage 20 has a lower housing 21. The storage 20 is composed of a lockable storage box, for example, a safe. In the front side of the lower housing 21, lockable storage door (not illustrated) is disposed.

Inside the lower housing 21, in order from the front, the stacking type storage 22, and a plurality (eight as the example illustrated in FIG. 1) of the winding type storage 23 is disposed.

The stacking type storage 22 is a stacking type storage unit in which a plurality of the banknotes is stored in the stacked state. The winding type storage 23 is a winding type storage unit in which a plurality of the banknotes is stored in a state of being wound around the rotating body. The winding type storage 23 comprises the banknote storage unit 40 (see FIG. 2 and FIG. 3) which will be described later. Each winding type storage 23 is connected to each other by the fifth diverter path 155.

At the inlet of the stacking type storage 22 and the winding type storage 23, a sensor (not illustrated) for detecting passing of the banknote is disposed. The sensor is, for example, an optical sensor comprising a light emitting unit that emits light such as infrared rays and a light receiving unit that receives light from the light emitting unit. The sensor may be any type of sensor as long as it can detect the passing of the banknotes through the inlet.

As illustrated in FIG. 1, in the case where a plurality of the winding type storage 23 is disposed, when a plurality of the winding type storage 23 is driven at the same time, the current consumption may exceed the allowable value. Therefore, even in the case where it is necessary to drive a plurality of the winding type storage 23, the timing for starting the driving of the respective winding type storage 23 may be different. The number of the winding type storage units 23 which can be simultaneously driven may be determined in advance. Thus, the current consumption for driving the winding type storage units 23 of the plurality of the winding type can be kept within the allowable range.

Figure 2:
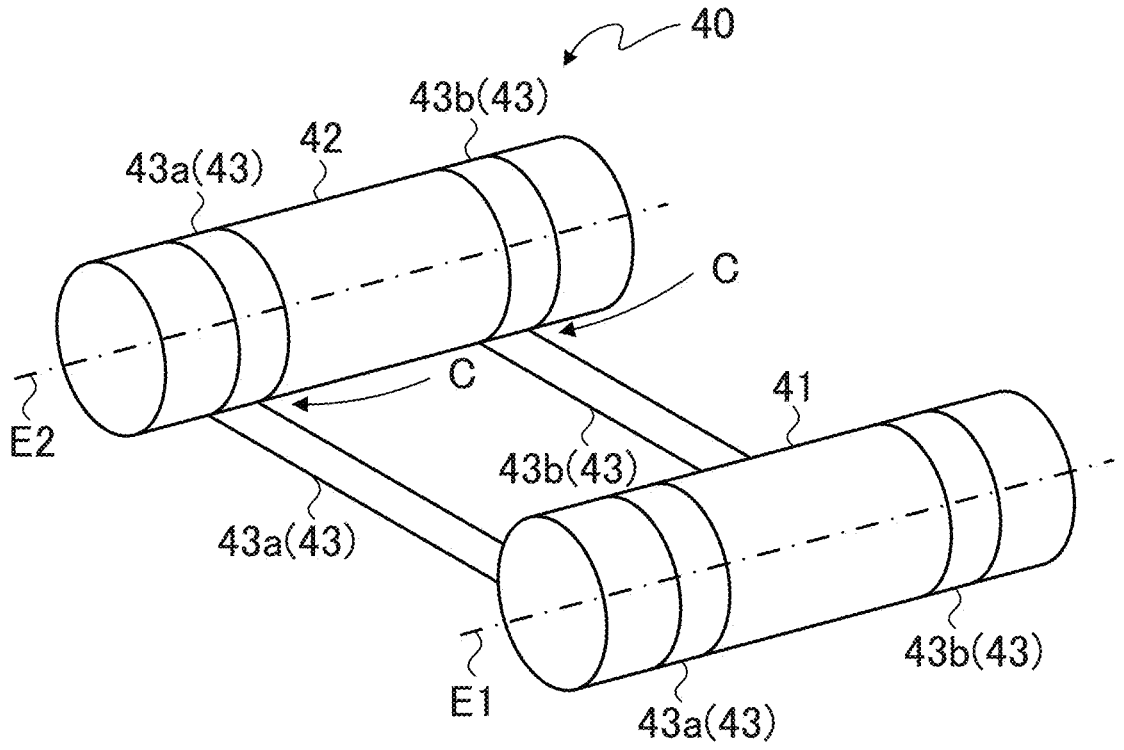
FIG. 2 is a schematic perspective view of a banknote storage unit.

The banknote storage unit 40 will be described with reference to FIG. 2 and FIG. 3. In FIG. 2, the illustration of a part of the components, such as the control unit 18 illustrated in FIG. 3, is omitted.

In the example illustrated in FIG. 1, the banknote storage unit 40 is disposed inside the temporary storage 17 and the winding type storage 23. However, the present disclosure is not limited to such a configuration. The banknote storage unit 40 may be configured to store the banknotes transported by the transport unit 15 and to feed out the stored banknotes to the transport unit 15. The banknote storage unit 40 can be incorporated into various sheet processing machines.

Figure 3:
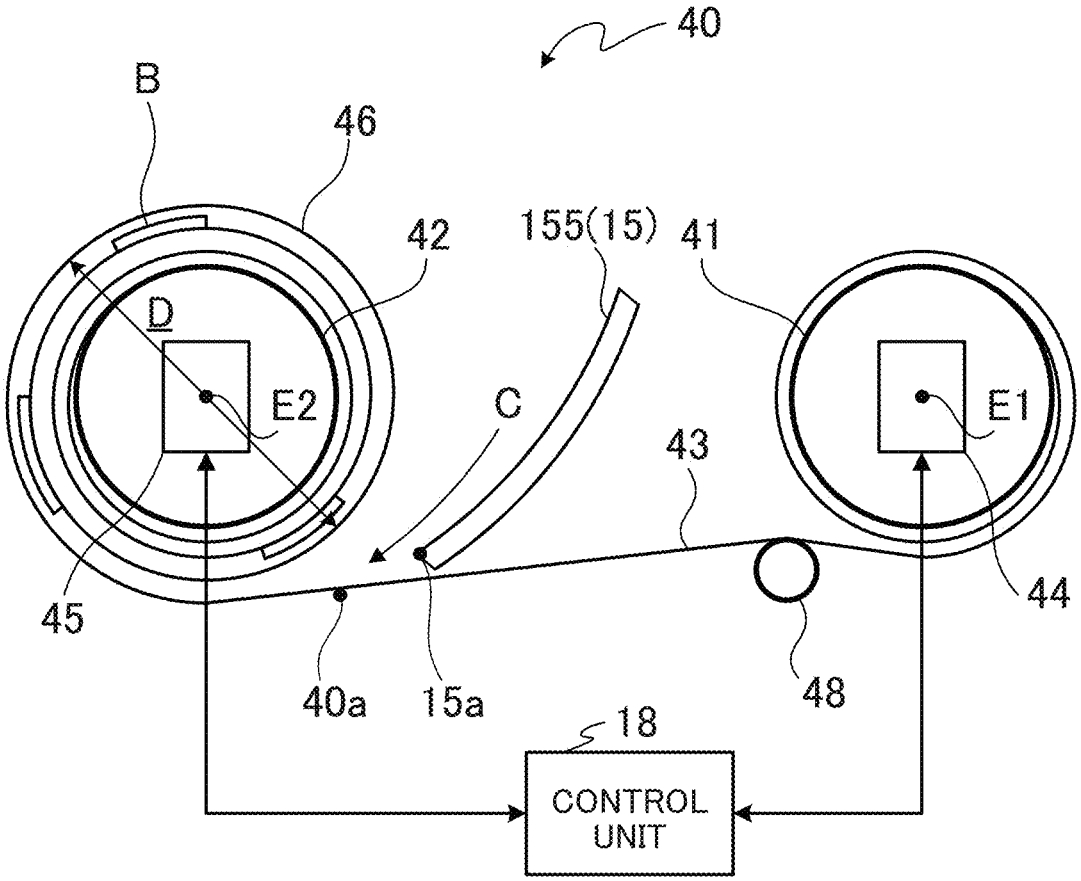
FIG. 3 is a schematic side view of a banknote storage unit.

As illustrated in FIG. 2 and FIG. 3, the banknote storage unit 40 comprises a reel 41, a drum 42, a pair of tapes 43*a*, 43*b*, a first stepper motor 44, a second stepper motor 45, and a tape movement detector 48. In the following, a pair of tapes 43*a*, 43*b* will be collectively referred to as tape 43, if necessary.

The operation of the banknote storage unit 40 is controlled by the control unit 18. More specifically, the control unit 18 controls the first stepper motor 44 and the second stepper motor 45 to store the banknotes in the banknote storage unit 40. The operation of the banknote storage unit 40 may be controlled by another control unit other than the control unit 18*z*. Another control unit may be one or more control units. In the case of more control units, each banknote storage unit 40 may be controlled by another control unit each other.

The reel 41 rotates around a rotation axis E1, by the operation of the first stepper motor 44 controlled by the control unit 18. A first end of the tape 43 is connected to the reel 41. The first end side of the tape 43 is wound on the reel 41.

The drum 42 is disposed so that a rotation axis E2 of the drum 42 is parallel to the rotation axis E1 of the reel 41. The drum 42 rotates around the rotation axis E2, by the operation of the second stepper motor 45 controlled by the control unit 18. A second end of the tape 43 is connected to the drum 42. The second end side of the tape 43 is wound on the drum 42.

The tape 43 is suspended between the reel 41 and the drum 42, in a state where the tension is applied.

The tape movement detector 48 comprises, for example, a rotary encoder, and is in contact with the tape 43 to which the tension is applied. The tape movement detector 48 is configured to send a signal of one pulse to the control unit 18 at every time that the tape 43 moves a predetermined amount. The control unit 18 can calculate the movement distance of the tape 43, i.e., the winding length or feeding length, by integrating the number of pulses that the tape movement detector 48 has emitted. The control unit 18 can calculate the movement speed of the tape 43 moving between the reel 41 and the drum 42, by integrating the number of pulses emitted per unit time.

A rotation of the reel 41 and the drum 42 when the banknotes are stored in the banknote storage unit 40 is referred to as a forward rotation. In the case of disposing the reel 41, the drum 42 and the tape 43 as illustrated in FIG. 3, the reel 41 and the drum 42 rotate in the same direction (clockwise direction in FIG. 3) each other. At this time, the tape 43 pulled out from the reel 41 is wound on the drum 42 together with the banknote B delivered from the transport unit 15. The drum 42 configures a winding body 46 together with the wound tape 43 and the banknote B. A symbol D in FIG. 3 is the diameter of the winding body 46. The movement speed of the tape on the outer peripheral surface of the winding body 46 is equal to the movement speed of the tape 43 moving between the reel 41 and the drum 42. Hereinafter, the movement speed of the tape 43 moving between the reel 41 and the drum 42 or the movement speed of the tape on the outer peripheral surface of the winding body 46 may simply be described as the movement speed of the tape 43.

Specifically, the banknote B delivered from the transport unit 15 is inserted between a portion of the tape 43 located on the outermost periphery of the winding body and a portion of the tape 43 that is suspended between the reel 41 and the drum 42, as illustrated by the arrow C in FIG. 2 and FIG. 3. The inserted banknote B is wound on the drum 42 together with the tape 43 by the rotation of the drum 42. A point indicated by 15*a* in FIG. 3 is a transport unit side action point located closest to the winding type storage 23 (i.e., the banknote storage unit 40) among the portions where the fifth diverter path 155 (transport unit 15) exerts a force to the banknote B. A point indicated by 40*a* in FIG. 3 is a storage side action point located closest to the transport unit 15 among the portions where the winding type storage 23 exerts a force to the banknote B. The banknote B in contact with the storage side action point 40*a* is wound inside the winding body 46 by the tape 43. Note that a portion of the transport unit 15 comprising the transport unit side action point 15*a* may be disposed inside the winding type storage 23. This portion of the transport unit 15 may be configured to be separable from the main body of the transport unit 15, and may be united with the winding type storage 23.

When the banknotes are fed out from the banknote storage unit 40, the reel 41 and the drum 42 rotate in a direction opposite to the forward rotation. The rotation at this time will be hereafter referred to as reverse rotation. In the case of disposing the reel 41, the drum 42, and the tape 43 as illustrated in FIG. 3, the reel 41 and the drum 42 rotates in the counterclockwise direction. At this time, the tape 43 pulled out from the drum is wound on the reel 41. The banknote B is delivered to the transport unit 15.

Specifically, the banknote B wound on the drum 42 is released from a state of sandwiching between a portion of the tape 43 and another portion of the tape 43, when the tape 43 is fed out from the drum 42 and wound on the reel 41. When released, the banknote B is fed in a direction opposite to the direction indicated by the arrow C. and is delivered to the transport unit 15.

The control unit 18 can control the first stepper motor 44 and the second stepper motor 45 in accordance with a state of the banknote storage unit 40 or the banknote processing machine 1, and can change the movement speed of the tape 43. The movement speed of the tape 43 is the movement speed of the banknote B in the banknote storage unit 40. The movement speed of the tape 43 at the time of winding the banknote B is the winding speed of the banknote B, and the movement speed of the tape 43 at the time of feeding out the banknote B is the feeding speed of the banknote B. The movement speed of the tape 43 can be calculated by using the tape movement detector 48 as described above.

The control unit 18 controls at least one of the first stepper motor 44 and the second stepper motor 45 in accordance with the state of the banknote storage unit 40 or the banknote processing machine 1, and can change the tension acting on the tape 43 that is suspended between the reel 41 and the drum 42.

The tension acting on the tape 43 can be adjusted by adjusting anyone or more of the rotational direction, the rotational speed, the torque of the reel 41, and the rotational direction, the rotational speed, the torque of the drum 42. The control unit 18 controls the rotational speed and the torque of the reel 41 and the drum 42 via controlling the rotational speed and the torque of the first stepper motor 44 and the second stepper motor 45, for example, by PWM (Pulse Width Modulation).

<Storing Banknotes in Winding Type Storage>

In the banknote processing machine 1 configured as described above, for example, the banknotes are stored in the winding type storage 23 as described below.

The banknotes that can be transported to the transport unit 15, such as the banknotes placed on the depositing unit 12 or the banknotes stored in the temporary storage 17, are transported to the transport unit 15. The transport unit 15 continuously transports the delivered banknotes at a predetermined transport speed. Since the banknotes are delivered to the transport unit 15 at a substantially constant pace, the distance between the front edge of the banknote moving on the transport unit 15 and the front edge of the subsequent banknote is substantially an equal interval. In the case where a plurality of the banknotes having the same length in the transport direction is continuously transported, the distance between the rear end of the banknote moving on the transport unit 15 and the front end of the subsequent banknote is substantially an equal interval. Hereinafter, the distance between the rear end of the banknote moving on the transport unit 15 and the front end of the subsequent banknote may be described as the interval between the banknotes. Similarly, the distance between the rear end of the banknote transported by the tape 43 and the front end of the subsequent banknote may be described as the interval between the banknotes. Note that the interval between the banknotes is a predetermined interval determined in advance. When the interval is smaller than the predetermined interval, the recognition unit 16 cannot recognize the banknotes one by one. In this case, it is determined as, for example, a sheet in a double feed state or a sheet deviated from a specified size, and the banknote which has been transported at a narrow interval is rejected.

The banknotes transported by the transport unit 15 are recognized by the recognition unit 16. Based on the recognition result, the transport destination of the banknotes is determined. Hereinafter, the explain will be continued on the assumption that all the banknotes are transported to the single winding type storage 23.

Figure 4A:
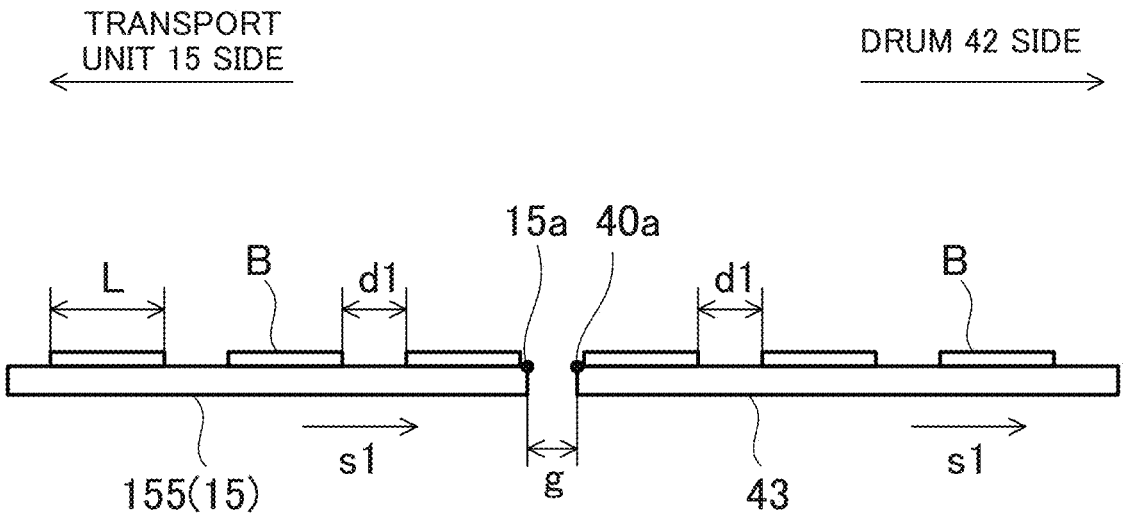
FIG. 4A is a conceptual diagram for explaining the delivering of the banknotes between the transport unit and the winding type storage.
Figure 4B:
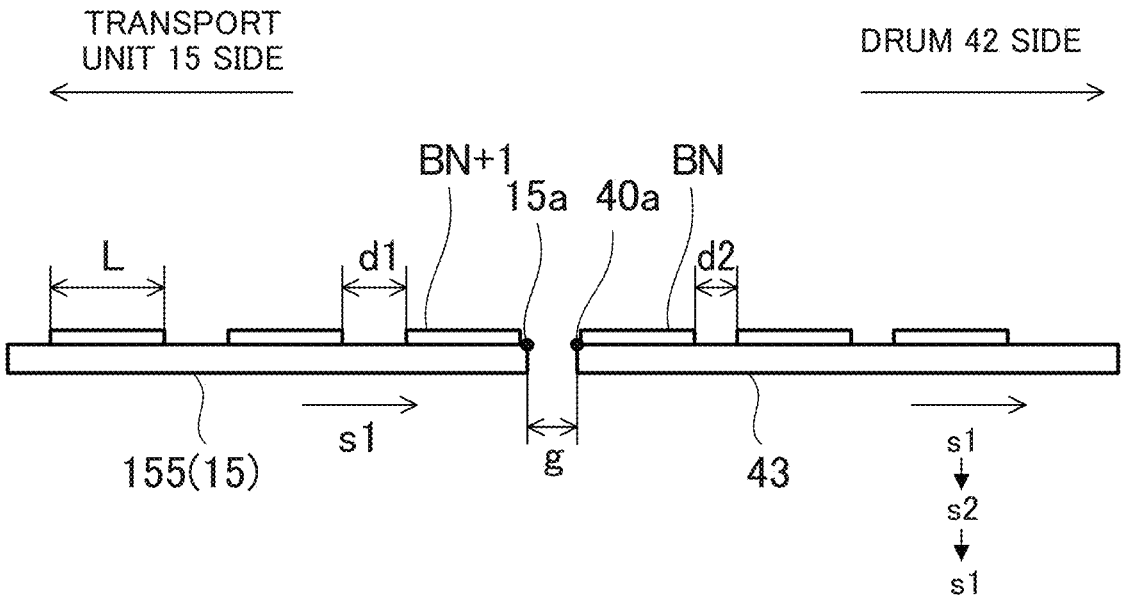
FIG. 4B is a conceptual diagram for explaining the delivering of the banknotes between the transport unit and the winding type storage.

FIG. 4A and FIG. 4B are conceptual diagrams for explaining the delivering of the banknotes between the transport unit 15 and the winding type storage 23 (i.e., the banknote storage unit 40). It should be noted that, it does not necessarily correspond to the shape and arrangement of the actual device because of the conceptual diagram.

The control in the case where the number of banknotes B stored in the winding type storage 23 is not specifically intended to be increased will be described, while referring to FIG. 4A.

The banknote B is transported at a speed s1 on the fifth diverter path 155 of the transport unit 15. The banknote B is delivered from the fifth diverter path 155 to the banknote storage unit 40, specifically, the tape 43, disposed in the winding type storage 23. The banknote B is transported on the tape 43 at the speed s1 equal to the speed at which the transport unit 15 transports the banknote B. This speed s1 is the movement speed of the tape 43 and the winding speed of the banknote B.

The distance g between the transport unit side action point 15*a* located closest to the winding type storage 23 (i.e., the banknote storage unit 40) among the portions where the fifth diverter path 155 exerts the force on the banknote B and the storage side action point 40*a* located closest to the transport unit 15 among the portions where the winding type storage 23 exerts the force on the banknote B is smaller than the length L of the banknote in the transport direction. Therefore, when delivering the banknote B between the transport unit 15 and the winding type storage 23, it is possible to prevent occurring a state in which the force is not received from any of the transport unit 15 and the winding type storage 23, and it is possible to reliably deliver the banknote B. In the case where a plurality of the types of banknotes B having different lengths L in the transport direction are to be processed in the banknote processing machine 1, the distance g is set so as to be shorter than the length in the transport direction of the banknote B having the smallest length L in the transport direction among the plurality of the types of banknotes B. By setting as above, all of the banknotes B to be processed can be reliably delivered.

The intervals between the banknotes B when being transported by the transport unit 15 is d1. The transport speed of the banknote B by the transport unit 15 and the movement speed of the banknote by the tape 43 are both s1. Therefore, the intervals between the banknotes B does not change before and after the delivery. That is, the intervals between the banknotes B when transported by the tape 43 remains d1.

Therefore, the banknote B is wound around the winding body 46, that is, the banknote B is stored in the winding type storage 23, while remaining the intervals d1 between the banknotes B when the banknote B is transported by the transport unit 15.

Next, the control capable of increasing the number of banknotes B stored in the winding type storage 23 will be described, while referring to FIG. 4B.

The difference from the case illustrated in FIG. 4A is that the movement speed of the tape 43 is not constant at s1, but after decelerating from s1 to s2, it returns to s1 again. More specifically, the movement speed of the tape 43 is decelerated from s1 to s2 relative to the transport speed s1 of the banknote by the transport unit 15, and then accelerated from s2 and returned to s1 again. In other words, the winding speed of the banknote B by the winding body 46 is reduced from s1 as a first winding speed to s2 as a second winding speed, and then increased from s2 as the second winding speed s2 to s1 as the first winding speed. As will be apparent from the following description, such a change in the winding speed is performed until one of the banknotes B (e.g., N-th banknote $B_N$) is wound and the next one of the banknotes B (e.g., (N+1)-th banknote $B_{N+1}$) is wounded.

After the rear end of the N-th banknote $B_N$ leaves from the transport unit side action point 15*a*, the banknote $B_N$ receives force from only the tape 43. Therefore, even if the movement speed of the tape 43 is different from the transport speed s1 of the transport unit 15, the compressive force (the force to bend) or the tension (the force to tear off) does not act on the banknote $B_N$.

It is possible to reduce the movement speed of the tape 43 from s1 to s2, after the rear end of the N-th banknote $B_N$ leaves from the transport unit side action point 15*a*. When the movement speed of the tape 43 is reduced, the (N+1)-th banknote $B_{N+1}$ still being transported by the transport unit 15 moves faster than the banknote $B_N$ transported by the tape 43, so that the interval between the two banknotes becomes smaller than d1.

If the movement speed of the tape 43 remains smaller than the transport speed s1 of the transport unit 15, when the front end in the transport direction of the banknote $B_{N+1}$ reaches the storage side action point 40*a*, the movement speeds of the front end side and the rear end side of the banknote $B_{N+1}$ are different in such a state, the compressive force acts on the banknote $B_{N+1}$, the banknote $B_{N+1}$ bends, and troubles such as jamming of the banknote may occur between the transport unit 15 and the winding type storage 23.

Therefore, the movement speed of the tape 43 is returned to s1 until the front end in the transport direction of the banknote $B_{N+1}$ reaches the storage side action point 40*a*. When the front end in the transport direction of the banknote $B_{N+1}$ reaches the storage side action point 40*a*, the force is exerted on the banknote $B_{N+1}$ to move at the speed s1 on the front end side and the rear end side. The banknote $B_{N+1}$ is smoothly delivered to and stored in the winding type storage 23. The interval between the banknote $B_N$ and the banknote $B_{N+1}$ is d2 which is smaller than d1.

As described above, the interval between the two banknotes can be reduced by reducing the movement speed of the tape 43 and returns to the previous speed, after the rear end in the transport direction of the N-th banknote $B_N$ leaves from the transport unit side action point 15*a*, until the front end in the transport direction of the (N+1)-th banknote $B_{N+1}$ reaches the storage side action point 40*a*. Thus, it is possible to increase the number of banknotes B stored in the winding type storage 23.

Such control is performed, based on one or more parameters indicating the state of the winding body 46, for example, in the case where the parameters reaches a predetermined value, or until the parameters reaches the predetermined value. The parameters indicating the state of the winding body 46 are, for example, any one of or a combination of the number of banknotes B wound on the drum 42, the length of the tape 43 wound on the drum 42, and the diameter or the radius of the winding body 46. The diameter or the radius of the winding body 46 is the diameter or radius of the winding body 46.

The smaller the mass of the winding body 46 is, the smaller the inertial force associated with the rotation of the winding body 46 is. The smaller the diameter or the radius of the winding body 46 is, the smaller the inertial force associated with the rotation of the winding body 46. That is, the smaller the mass, diameter, or radius of the winding body 46 is, the more quickly the rotational speed of the winding body 46 can be increased or reduced. The above described control can be performed more effectively when the mass, diameter, or radius of the winding body 46 is small, in other words, when the number of banknotes B wound on the drum 42 is small.

The control unit 18 can obtain the number of banknotes B wound on the drum 42 based on the detection result of the sensor disposed at the inlet of the winding type storage 23. The control unit 18 may perform control to reduce and increase the winding speed, for example, until the number of the wound banknotes B reaches a predetermined value.

Since the banknotes B are wound on the winding body 46 at the predetermined intervals of, for example, d1 or d2, the length of the tape 43 wound on the drum 42 can indirectly indicate the number of banknotes B wound on the drum 42. The length of the tape 43 wound on the drum 42 can be obtained based on the signal received from the tape movement detector 48. The control unit 18 may perform the control to reduce and increase the winding speed, for example, until the length of the wound tape 43 reaches a predetermined length, in other words, until the number of wound banknotes B reaches a predetermined number.

Similar to the length of the tape 43 wound on the drum 42, the diameter or radius (e.g., diameter D) of the winding body 46 can indirectly indicate the number of banknotes B wound on the drum 42. The control unit 18 may perform the control to reduce and increase the winding speed, for example, until the diameter D of the winding body 46 reaches a predetermined value, The control unit 18 can obtain the diameter D of the winding body 46 based on the number of steps of the second stepper motor 45 and the number of pulses of the tape movement detector 48 per unit time. Specifically, it is possible to obtain the rotation angle of the drum 42, that is, the winding body 46, per unit time, based on the number of steps of the second stepper motor 45. The length of the tape 43 wound per unit time, that is, the length of the arc drawn by one point on the outermost peripheral portion of the winding body 46 moves per unit time can be obtained based on the number of pulses of the tape movement detector 48. When the rotation angle of the winding body 46 per unit time is θD, the length of the are formed by the tape 43 wound per unit time is a, the diameter D of the winding body 46 is represented by D=2a/θD. Therefore, the control unit 18 can obtain the diameter D of the winding body 46, based on the number of steps of the second stepper motor 45 and the number of pulses of the tape movement detector 48 per unit time.

The intervals between the banknotes B wound on the drum 42 may be changed over a plurality of the stages. For example, in an initial stage at which winding is started, the interval is set to a first distance which is an extremely short distance, in a middle stage after winding to some extent, the interval may be set to a second distance which is slightly longer than the first distance, and in a later stage after winding, the interval may be set to a third distance which is longer than the second distance. Thus, at each stage, it is possible to realize the maximum number of sheets to be stored in the range where the inertial force of the winding body 46 allows.

The intervals between the banknotes B may be adjusted every time one banknote B is wound. Thus, the shape of the winding body 46 can be approached to an exact circle, it is possible to prevent the winding body 46 becomes elliptical shape in advance.

Next, the shortening amount of the banknote intervals will be described with reference to FIG. 5. The time chart in the case described referring to FIG. 4B is indicated by a broken line in the upper part of FIG. 5. This time chart will be described.

Until the time t1, the banknote $B_N$ transported by the transport unit 15 and the tape 43 moves at the speed s1.

At the time t1, the rear end in the transport direction of the banknote $B_N$ leaves from the transport unit side action point 15*a*. At this time, the deceleration of the tape 43, that is, the reduction of the winding speed, is started. The tape 43 and the banknote $B_N$ are decelerated at a predetermined deceleration rate.

At the time t2, the deceleration of the tape 43 is completed. At this time, the speed of the tape 43 and the banknote $B_N$ is s2. At the same time, the tape 43 starts to be accelerated. The tape 43 and the banknote $B_N$ are accelerated at a predetermined acceleration rate. If possible, s2 may be 0

At the time t3, the speed of the tape 43 and the banknote $B_N$ reaches s1. The acceleration of the tape 43 is completed. At the same time, the front end in the transport direction of the banknote $B_{N+1}$ reaches the storage side action point 40*a*, and starts to be transported by the transport unit 15 and the tape 43.

Figure 5:
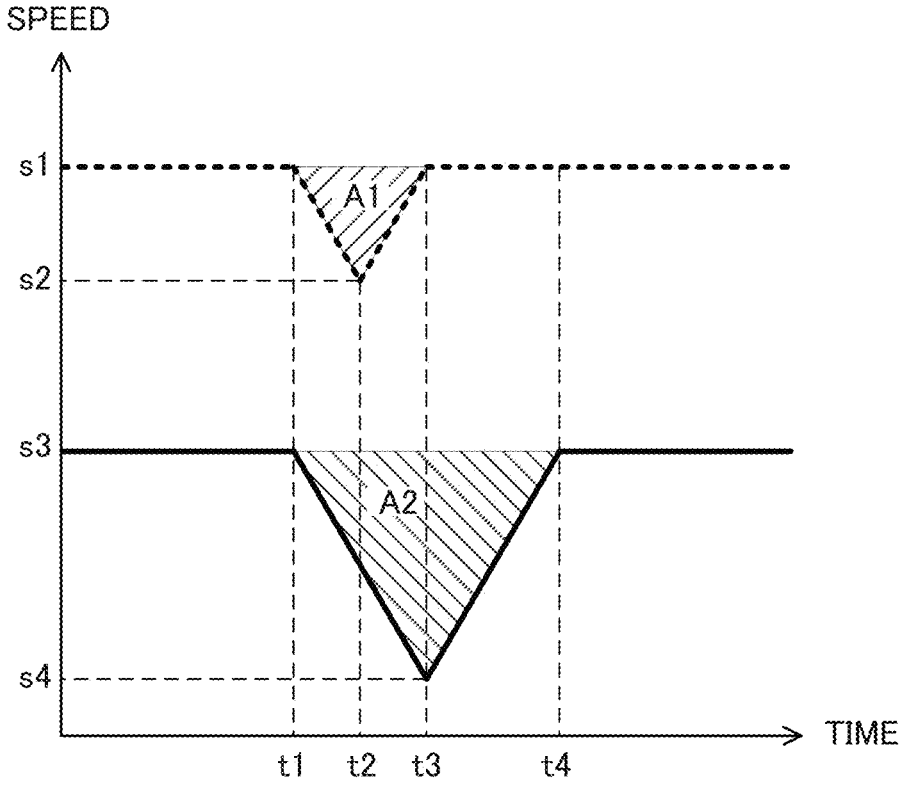
FIG. 5 is a diagram for describing the shortening amount of the banknote intervals in the case where the banknotes are continuously stored.

In FIG. 5, area of the region indicated by A1 corresponds to the shortening amount of the interval between the banknote $B_N$ and the banknote $B_{N+1}$ (i.e., the difference between d1 and d2). The time t3 is determined so as to be a value obtained by dividing the interval d1 between the banknote $B_N$ and the banknote $B_{N+1}$ before the interval between the time t3 and the time t1 is shortened, by the speed s1 (i.e., t3−t1=d1/s1). The time t2 is determined based on the deceleration rate and acceleration rate of the tape 43, and the difference between the time t3 and t1. For example, in the case where the absolute values of deceleration rate and acceleration rate of the tape 43 are equal, the time 12 is determined at the time of the center of the time t1 and the time 13 (i.e., t2−t1=t3−t2).

The speed s2 is a target speed determined based on the time (t2−t1) that can be secured for deceleration, the time (t3−t2) that can be secured for acceleration, the deceleration rate, and the acceleration rate. The sum of the time that can be secured for deceleration and the time that can be secured for acceleration is naturally determined by the transport speed s1 in the transport unit 15 and the interval d1 between the banknotes B. The time that can be secured for each of deceleration and acceleration is determined by the absolute values of the deceleration rate and acceleration rate. Therefore, it can be said that the speed s2, which is the target speed, is determined depending on the deceleration rate and acceleration rate, and can be achieved by adjusting the deceleration rate and acceleration rate.

The deceleration rate and acceleration rate of the winding body 46, that is, the adjustment of the rate of change of the winding speed can be performed by adjusting the tension of the tape 43. The tension of the tape 43 is performed accurately, in a state in which the tension is applied without loosening the tape 43, by controlling the rotation of the first stepper motor 44 and the second stepper motor 45.

In Embodiment, it is possible to reduce the transport speed of the transport unit 15 and the movement speed of the tape 43, that is, the winding speed of the winding body 46. A solid line illustrated on the lower side of FIG. 5 illustrates a time chart in the case of reducing the transport speed of the transport unit 15.

Until the time t1, the transport unit 15 and the tape 43 transport the banknote $B_N$ at a speed s3 slower than the speed s1. The first winding speed in this case is s3. Although not limited particularly, FIG. 5 illustrates the case where the speed s3 is half the speed s1.

At the time t1, the rear end of in the transport direction the banknote B leaves from the transport unit side action point 15*a*. At this time, the deceleration of the tape 43, that is, the reduction of the winding speed, is started. In other words, deceleration of the winding speed toward the target speed is started. The tape 43 and the banknote $B_N$ are decelerated at a predetermined deceleration rate. The deceleration rate at this time may be equal to or different from the deceleration rate in the case where the transport speed of the transport unit 15 is not reduced (the case indicated by a broken line in FIG. 5). FIG. 5 illustrates the case where both deceleration rate is equal.

At the time t3, the deceleration of the tape 43 is completed. At this time, the speed of the tape and the banknote $B_N$ is s4. That is, the second winding speed in this case is s4. At the same time as the deceleration of the tape 43 is completed, the tape 43 starts to accelerate. The tape 43 and the banknote $B_N$ are accelerated at a predetermined acceleration rate. The acceleration rate at this time may be equal to or different from the acceleration rate in the case where the transport speed of the transport unit 15 is not reduced (the case indicated by a broken line in FIG. 5). FIG. 5 illustrates the case where both acceleration rate is equal.

At the time t4, the speed of the tape 43 and the banknote $B_N$ reaches s3. The acceleration of the tape 43 is completed. At the same time, the front end in the transport direction of the banknote $B_{N+1}$ reaches the storage side action point 40*a*, and starts to be transported by the transport unit 15 and the tape 43.

In FIG. 5, area of the region indicated by A2 corresponds to the shortening amount of the interval between the banknote $B_N$ and the banknote $B_{N+1}$ (i.e., the difference between d1 and d2), in the case where the transport speed of the transport unit 15 is reduced. The time t4 is determined so that the difference between the time t4 and the time t1 is a value that the interval d1 between the banknote $B_N$ and the banknote $B_{N+1}$ before shortened is divided by the speed s3 (i.e., t4−t1=d1/s3). The time t3 is determined based on the deceleration rate and the acceleration rate of the tape 43, and the difference between the time 4 and t. For example, in the case where the absolute values of deceleration rate and acceleration rate of the tape 43 are equal, the time t3 is determined at the time of the center of time t1 and time t4 (i.e., t3−t1=t4−t3).

The speed s4 is a target speed determined based on the time (t3−t1) that can be secured for deceleration, the time (t4−t3) that can be secured for acceleration, the deceleration rate, and the acceleration rate. The sum of the time that can be secured for deceleration and the time that can be secured for acceleration is naturally determined by the transport speed s3 in the transport unit 15 and the interval d1 between the banknotes B. The time that can be secured for each of deceleration and acceleration is determined by the absolute values of deceleration rate and acceleration rate. Therefore, it can be said that the speed s4, which is the target speed, is determined depending on the deceleration rate and the acceleration rate, and can be achieved by adjusting the deceleration rate and the acceleration rate.

As is apparent from FIG. 5, the area of the region A2 is larger than the area of the region A1. That is, by reducing the transport speed of the transport unit 15, the intervals between the banknotes B can be further shortened. The reason why the area of the region A2 becomes larger than the area of the region A1 is as follows.

When the transport speed of the transport unit 15 and the movement speed of the tape 43 before reduction are reduced from s1 to s3, it takes a long time from the rear end in the transport direction of the banknote $B_N$ leaves from the transport unit side action point 15*a* until the front end in the transport direction of the banknote $B_{N+1}$ reaches the storage side action point 40*a*. That is, the time at which the deceleration is completed is delayed from t2 to t3, and the time at which the acceleration is completed is delayed from t3 to t4. Since these times are delayed, the difference between the speeds before and after deceleration becomes large. That is, the difference between s3 and s4 is larger than the difference between s1 and s2. Therefore, the area of the region A2 is larger than the area of the region A1.

Therefore, in the present embodiment, by reducing the transport speed of the banknotes by the transport unit 15, it is possible to reduce the intervals between the banknotes B stored in the winding type storage 23, thus, it is possible to increase the number of banknotes B stored in the winding type storage 23.

In FIG. 5, the state in the case where the transport speed is s1 and s3, and in the case where the deceleration rate and the acceleration rate are assumed to be equal is illustrated. Since s3 is smaller than s1, the inertial force of the winding body 46 is smaller in the case where the transport speed is s3 than in the case where it is s1. Therefore, in the case where the transport speed is s3, it is possible to increase the absolute value of the deceleration rate and acceleration rate than the case where the transport speed is s1, that is, to reach the target speed s4 more quickly and to return to the previous speed s3 more quickly. With such a configuration, the target speed s4 can be made smaller than the value illustrated in FIG. 5, and the area of the region A2 can be made larger. That is, the amount of shortening of the interval between the banknote $B_{N+1}$ and the banknote $B_{N+1}$ can be increased. The smaller the target speed s4 is, the greater the amount of shortening of the interval between the banknote $B_N$ and the banknote $B_{N+1}$ is. The target speed s4 which is the second winding speed, may be 0.

In the case where it is possible to increase the absolute value of the deceleration rate and acceleration rate, after setting the target speed s4 to 0, it may be stopped rotation of the winding body 46 for a predetermined time. In this case, the shape of the region corresponding to the region A2 becomes trapezoidal, the area of this region becomes larger, and the amount of shortening of the interval between the banknote $B_N$ and the banknote $B_{N+1}$ can be further increased.

It is preferable that the transport speed is reduced as s3 during a time period in which the operation rate of the banknote processing machine 1 is lowered, such as at night. The control unit 18 may obtain the time information, and perform the above-described control based on the time information, for example, after the business hours of the shop in which the banknote processing machine 1 is installed.

Further, s3 is smaller than s1. The banknote processing machine 1 is quieter when the transport unit 15 is moving in s3 than when the transport unit 15 is moving in s1. The transport speed may be actively reduced as the so-called silent mode during the business hours of the shop.

Although the case where the banknotes B are continuously stored in the winding type storage has been described up to here, the effect described above is not limited to such a case. Even in the case where the banknotes B are stored intermittently, that is, there is a relatively long time interval between the storage of one banknote B and the storage of the next banknote B, it is possible to obtain the effect of increasing the storage amount by changing the intervals between the wound banknotes and reducing the transport speed by the transport unit 15.

Figure 6:
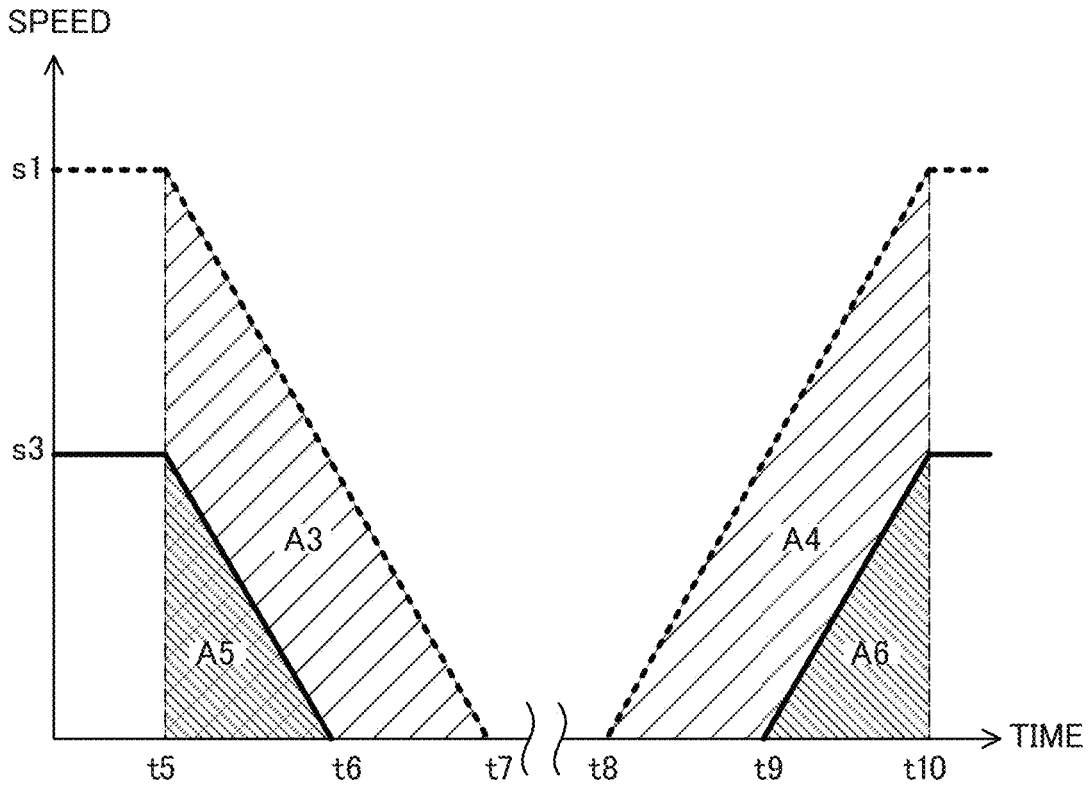
FIG. 6 is a diagram for describing the shortening amount of the banknote intervals in the case where the banknotes are intermittently stored.

FIG. 6 is a time chart illustrating the movement speed of the banknote $B_N$ when the banknotes B are intermittently stored in the winding type storage 23. A time chart in the case where the transport speed of the banknote is s1 which is relatively high is illustrated by a broken line. A time chart in the case where the transport speed of the banknote is s3 which is slower than s1 is illustrated by the solid line.

A case where the transport speed of the banknote is s1 will be described. At the time t5, when the rear end in the transport direction of the intermittently transported banknote $B_N$ passes through, for example, the transport unit side action point 15*a*, the control unit 18 stops the second stepper motor 45. The winding body 46 configured by the drum 42, the tape 43, and the banknotes N wound up to that time has a certain amount of mass. Therefore, the winding body 46 is rotated to some extent by the inertial force, the winding body 46 actually stops at the time t7, and the banknote $B_N$ is moved to some extent by the tape 43 between the time t5 and the time t7. The amount of movement at this time corresponds to the area of the triangular region indicated by A3 in FIG. 6.

The movement speed of the tape 43 needs to reach s1 before the front end in the transport direction of the next banknote $B_{N+1}$ reaches the storage side action point 40*a*. As described above, the winding body 46 has a certain mass. Therefore, even when the driving of the second stepper motor 45 is started, the rotational speed of the winding body, that is, the movement speed of the tape 43 does not immediately become s1. In the case where the time at which the front end in the transport direction of the banknote $B_{N+1}$ reaches the storage side action point 40*a* is expected to be t10, it is necessary to start the movement of the tape 43 from the time t8, which is a time somewhat earlier than the time 110. The amount of movement at this time corresponds to the area of the triangular region indicated by A4 in FIG. 6.

In the case where the banknotes B are intermittently stored, finally, the intervals between the banknotes B is determined as follows.

(1) Contribution by the Operation Control of the Drum 42

By controlling the operation of the drum 42, the tape 43 moves by a predetermined distance (corresponding to the sum of the areas of the region A3 and the region A4) between the times t5 and t10. As described above, the time t5 is the timing at which the rear end of the banknote $B_N$ comes to the transport unit side action point 15*a* and the speed of the tape 43 starts to be decelerated from s1. The time t5 is the timing at which the second stepper motor 45 stops. The time t10 is a timing at which the front end of the banknote $B_{N+1}$ reaches the storage side action point 40*a* and the speed of the tape 43 returns to s1.

(2) Contribution by the Operation Control of the Transport Unit 15

By controlling the operation of the transport unit 15, the banknote $B_{N+1}$ is transported between the time t5 and t10. At the time point of t10, the front end of the banknote $B_{N+1}$ is located on the upstream side in the moving direction of the storage side action point 40*a*, that is, on the side of the transport unit 15. On the other hand, at the time 100, the closer the front end of the banknote $B_{N+1}$ is to the storage side action point 40*a*, the greater the effect of reducing the intervals between the banknotes B is. Hereinafter, the distance between the front end of the banknote $B_{N+1}$ and the transport unit side action point 15*a* at the time t10 (the length of the banknote $B_{N+1}$ protruding from the transport unit side action point 15*a*) is defined as X.

(3) Interval Between the Banknotes B (Interval Between the Trailing Edge of the Banknote $B_N$ and the Leading Edge of the Banknote $B_{N+1}$ in the Transport Direction)

The operation control of the transport unit 15 and the drum 42 may be appropriately changed as long as the condition that the movement speed of the tape 43 reaches s1 until the front end in the transport direction of the banknote $B_{N+1}$ next of the banknote $B_N$ reaches the storage side action point 40*a* is satisfied. Based on the above (1) and (2), the interval d2 between the banknotes B stored in the winding type storage 23 is determined as follows. The interval d2=(the area of the region A3+the area of the region A4)−(the distance X between the front end of the banknote $B_{N+1}$ stored next and the transport unit side action point 15*a*, at the time when the movement speed of the tape 43 returns to the speed s1 same as the transport speed s1 of the transport unit 15).

Even in the case where the banknotes B are intermittently stored, by increasing the deceleration rate and acceleration rate of the first stepper motor 44 and the second stepper motor 45, it is possible to reduce the area of the region A3 and the region A4, that is, to reduce the interval d2 between the banknotes B. Thus, it is possible to increase the number of banknotes B to be stored. In the case where the distance X is larger than the sum of the area of the region A3 and the area of the region A4, the banknotes B are wound on the drum in a state of partially overlapped each other. In the case where such a state is unacceptable, the sum of the area of the region A3 and the area of the region A4 may be adjusted to be equal to or greater than the distance X.

Next, a case where the transport speed of the banknotes is s3 will be described. Although not limited particularly, FIG. 6 illustrates a case where the speed s3 is half the speed s1.

At the time t5, when the rear end of in the transport direction the intermittently transported banknote $B_N$ passes through, for example, the transport unit side action point 15*a*, the control unit 18 stops the second stepper motor 45. As described above, the winding body 46 has a certain mass. The winding body 46 is rotated to some extent by the inertial force. It is the time t6 that the winding body 46 actually stops (that is, the winding speed becomes 0), and between the time t5 and time t6, the banknote $B_N$ is moved to some extent by the tape 43. The amount of movement at this time corresponds to the area of the region indicated by A5 in FIG. 6.

The movement speed of the tape 43 needs to reach s3 before the front end in the transport direction of the next banknote $B_{N+1}$ reaches the storage side action point 40*a*. As described above, the winding body 46 has a certain mass. Therefore, even when the driving of the second stepper motor 45 is started, the rotational speed of the winding body, that is, the movement speed of the tape 43 does not immediately become s3. In the case where the time at which the front end in the transport direction of the banknote $B_{N+1}$ reaches the storage side action point 40*a* is expected to be t10, it is necessary to start the movement of the tape 43 from the time t9, which is a time somewhat earlier than time t10.

The amount of movement at this time corresponds to the area of the region indicated by A6 in FIG. 6.

The final interval d2 between the banknotes B in the case where the banknotes are intermittently transported at the transport speed s3 is determined in the same manner as in the case where the transport speed is s1. That is, it is determined as follows. The interval d2 between banknotes B=(the area of the region A5+the area of the region A6)−(the distance X between the front end of the banknote $B_{N+1}$ to be stored next and the transport unit side action point 15*a* at the time when the movement speed of the tape 43 returns to the speed s3 same as the transport speed s3 of the transport unit 15).

As is apparent from FIG. 6, the sum of the areas of the region A5 and the region A6 is smaller than the sum of the areas of the region A3 and the region A4. That is, even when the banknotes B are intermittently transported, the intervals between the banknotes B can be shortened by reducing the transport speed of the transport unit 15. Thus, it is possible to increase the number of banknotes B stored in the winding type storage 23. In the case where the distance X is larger than the sum of the area of the region A5 and the area of the region A6, the banknotes B are wound on the drum in a state of partially overlapped each other. When such a state is unacceptable, the sum of the area of the region A5 and the area of the region A6 may be adjusted to be equal to or greater than the distance X.

In FIG. 6, the case where the transport speed is s1, and the case where the speed is s3 in assuming that the deceleration rate and acceleration rate are equal is illustrated. Since s3 is smaller than s1, the inertial force of the winding body 46 is smaller in the case where the transport speed is s3 than in the case where the transport speed is s1. Therefore, it is possible to increase the absolute value of the deceleration rate and acceleration rate in the case where the transport speed is s3 than the cases where the transport speed is s1, that is, to stop more quickly and to reach s3 more quickly. The areas of the region A5 and the region A6 can be made smaller than the region illustrated in FIG. 6, and the amount of shortening of the interval between the banknote $B_N$ and the banknote $B_{N+1}$ can be made larger. That is, it is possible to increase the number of banknotes B stored in the winding type storage 23.

It is needless to say that the increase in the number of stored banknotes B can be made in the temporary storage 17 comprising the banknote storage unit 40 in the same manner as in the winding type storage 23.

The control unit 18 can calculate the number of banknotes B that can be further wound by the drum 42 at a certain time point, based on the length of the tape 43 wound on the reel 41 and the set interval between the banknotes B. For example, in the case where the length of the tape 43 wound on the reel 41 is set to $L_{Tape}$, the length of the banknotes B in the transport direction is set to L, and the interval between the banknotes B in the state wound on the drum 42 is set to d2, the number of the banknotes B that can be wound further by the drum 42 can be expressed by $L_{Tape}/(L+d2)$. Therefore, the control unit 18 can calculate the number of banknotes B that can be further wound by the drum 42 based on this equation.

The length $L_{Tape}$ of the tape 43 wound on the reel 41 can be calculated based on the rotation amount, that is, rotation angle of the reel 41, the feeding length of the tape 43 from the reel 41, and the thickness of the tape 43. Specifically, the rotation angle of the reel 41 per unit time can be obtained from the number of steps of the first stepper motor 44. The length of the tape 43 fed out per unit time, that is, the length of the arc configuring the outermost peripheral portion of the cylindrical body formed by the tape wound on the reel 41 can be obtained from the number of pulses of the tape movement detector 48. In the case where the rotational angle of the reel 41, that is, the cylindrical body per unit time is set to θR, and the length of the arc of the tape 43 fed out per unit time is set to b, the diameter of the cylindrical body is represented by 2b/θR. The length $L_{Tape}$ of the tape 43 wound on the reel 41 can be calculated by dividing the difference in the diameter of the reel 41 by the thickness of the tape 43.

According to the above procedures, the length $L_{Tape}$ of the tape 43 wound on the reels 41 can be detected at any desired time. Therefore, the tape 43 can be used without waste, and thus, the number of banknotes B stored in the winding type storage 23 can be increased.

The length $L_{Tape}$ of the tape 43 wound on the reel 41 can be detected also by performing the operation that all the usable amount of the tape 43 remaining on the reel 41 is wound on the drum 42 once, and is rewound on the reel 41. The length $L_{Tape}$ of the tape 43 remained on the reel 41, that is, wound on the reel 41 can be detected based on the number of pulses the tape movement detector 48 emits during this operation is performed. It can be grasped that all the usable amount of the tape 43 remaining on the reel 41 is wound on the drum 42 in the case where an optical sensor disposed in the winding type storage 23 of the winding type detects marks attached to a predetermined position.

As described above, the reel 41 and the drum 42 are reversely rotated so that the banknotes B wound on the drum 42 can be fed out to the transport unit 15. When the banknotes B are fed out from the drum 42 to the transport unit 15, the control unit 18 can set the interval between the banknotes B transported by the transport unit 15 to be different from the interval between the banknotes B in a condition in which the banknotes B are wound on the drum 42. Specifically, by controlling the rotation of the first stepper motor 44 and the second stepper motor 45, the interval between the banknotes B transported by the transport unit 15 can be changed to a predetermined interval set in advance. By setting the interval to the predetermined interval, the recognition unit 16 can recognize the banknotes B one by one. That is, it is possible to prevent the banknotes B from being rejected.

The intervals between the banknotes B wound on the drum 42 may differ individually. Also, depending on whether or not the banknote has been wound by the drum 42 at the initial stage of starting the winding of the banknotes, there is a possibility that the intervals between the wound banknotes B may differ. Therefore, unless the intervals between the banknotes B in the state in which the banknotes B are wound on the drum 42 is accurately grasped, the intervals between the banknotes B fed out to the transport unit 15 cannot be set to the target interval.

When the banknotes B are wound on the drum 42, the control unit 18 may store the intervals between the banknotes B one by one individually in the memory unit 19. In this way, when the banknote B wound on the drum 42 is fed out to the transport unit 15, the control unit 18 can control the feeding speed based on the intervals between the banknotes B in the state of being wound on the drum 42. That is, the control unit 18 can adjust the intervals between the banknotes B transported by the transport unit 15 by controlling the rotation of the first stepper motor 44 and the second stepper motor 45, based on the intervals between the banknotes B stored in the memory unit 19.

It can be realized that the intervals between the banknotes B transported by the transport unit 15 is set to intervals different from the intervals between the banknotes B in the state in which the banknotes B are wound on the drum 42 by performing an operation opposite to the operation when winding the banknotes B on the drum 42 while narrowing the interval between the banknotes B. That is, the control unit 18 reduces the feeding speed of the winding body 46 from the first feeding speed (the same speed as the transport speed of the transport unit 15) to the second feeding speed. When the feeding speed of the winding body 46 reaches the second feeding speed, the control unit 18 increases the feeding speed of the winding body 46 to the first feeding speed. By controlling the deceleration rate when reducing from the first feeding speed to the second feeding speed and the acceleration rate when increasing from the second feeding speed to the first feeding speed, the interval between the banknotes B transported by the transport unit 15 can be set to the desired interval.

As described above, the control unit 18 can obtain the diameter or radius of the winding body 46, for example, the diameter D, based on the number of steps of the second stepper motor 45 and the number of pulses of the tape movement detector 48 per unit time. The control unit 18 can verify the validity of the diameter D based on the number and type of the wound banknotes B and the set intervals d2 between the banknotes B. The method of verification is as follows.

The length L in the transport direction and the thickness of the banknotes B are known based on the type of the wound banknotes B. Also, the thickness of the tape 43 is known. The theoretical value of the diameter D of the winding body 46 can be calculated based on the number and type of the wound banknotes B and the set interval d2 between the banknotes B. The theoretical value of the diameter D of the winding body 46 may be calculated in consideration of the presence or absence of irregularities due to printing of the banknotes B and the positions of the banknotes when the banknotes B is wound on the drum.

Therefore, it is possible to verify the validity of the diameter D by comparing the diameter D obtained based on the number of steps of the second stepper motor 45 and the number of pulses of the tape movement detector 48 per unit time with theoretical value, in the case where the deviation from the theoretical value is large, there is a possibility that the banknote having an unexpected thickness is wound. An example of the banknote B having an unexpected thickness is a banknote that does not become flat or is difficult to become flat because of the formation of wrinkles, folds, and/or the like. In the case where the number of such banknotes increases, when the banknotes are later transferred to a collection bag and/or the like, there is a possibility that the banknotes cannot be properly stored in the bag and/or the like. Therefore, by verifying the validity of the diameter D in advance and recognizing that the deviation from the theoretical value is large, it becomes possible to take measures before the collection.

The large deviation may be caused by an abnormality of a mechanism configuring the banknote storage unit 40, for example, the first stepper motor 44 and the second stepper motor 45. Therefore, by verifying the validity of the diameter D, it is possible to detect the abnormality of the banknote storage unit 40 early before an actual problem such as damage or jamming of the banknotes B due to slack of the tape 43 occurs.

The control unit 18 may calculate the diameter of the winding body 46 in a plurality of the states in which the rotation angles of the drums 42 are different from each other and compare a calculated plurality of the diameters of the winding body 46 to detect the abnormality in which the banknote B having the above described unexpected thickness is wound or the abnormality in each of the stepper motors 44, 45.

For example, the control unit 18 calculates a first diameter of the winding body 46 when the second stepper motor 45 is in a first number of step, and a second diameter of the winding body 46 when the second stepper motor 45 is in a second number of step. The difference between the first number of step and the second number of step corresponds to, for example, 180° at the rotation angle of the drum 42. That is, in this case, the control unit 18 calculates the diameter of the winding body 46 in each state of the two different rotation angles of the drum 42 each other.

In the case that the calculated difference between the first diameter and the second diameter is within a predetermined range, the control unit 18 determines that the banknotes B are normally wound. The control unit 18 determines that there is the abnormality in the case where the difference between the first diameter and the second diameter exceeds the predetermined range. In the case where it is determined that there is the abnormality, the control unit 18 may adjust the intervals between the banknotes B so that more banknotes B are wound, in the number of steps with smaller diameter.

The control unit 18 may calculate the outer peripheral shape of the winding body 46, by using a plurality of the diameters calculated based on a plurality of the number of steps different from each other of the second stepper motor 45. The more the number of a plurality of the calculated diameters of the winding body 46 is, the higher the accuracy of the outer peripheral shape becomes. For example, the diameter of the winding body 46 may be calculated every time when the number of steps of the second stepper motor 45 advances 45° in terms of the rotation angle of the drum 42. In this case, the diameters of a total of eight winding bodies 46 are calculated. The diameter of the winding body 46 may be calculated every time when the number of steps of the second stepper motor 45 advances 9° in terms of the rotation angle of the drum 42. In this case, the diameters of a total of forty winding bodies 46 are calculated.

In the case where roundness of the outer peripheral shape calculated from a plurality of the diameters of the winding bodies 46 of which rotational angles of the drum different from each other is within a predetermined range, the control unit 18 determines it is normal. The control unit 18 determines that there is an abnormality, in the case where the roundness of the outer peripheral shape calculated from a plurality of the diameters of the winding body 46 exceeds the predetermined range. In the case when determining that there is the abnormality, the control unit 18 may adjust the intervals between the banknotes B so that the outer peripheral shape of the winding body 46 approaches an exact circle. The roundness can be determined by various methods. Specifically, it may be performed determination of the roundness by evaluating the deviation of a plurality of the diameters of the winding body 46. The control unit 18 may determine whether the outer peripheral shape of the winding body 46 is an elliptical shape, by using a plurality of the diameters of the winding body 46. The control unit 18 may adjust the intervals between the banknotes B so that the outer peripheral shape of the winding body 46 approaches an exact circle.

Figure 7:
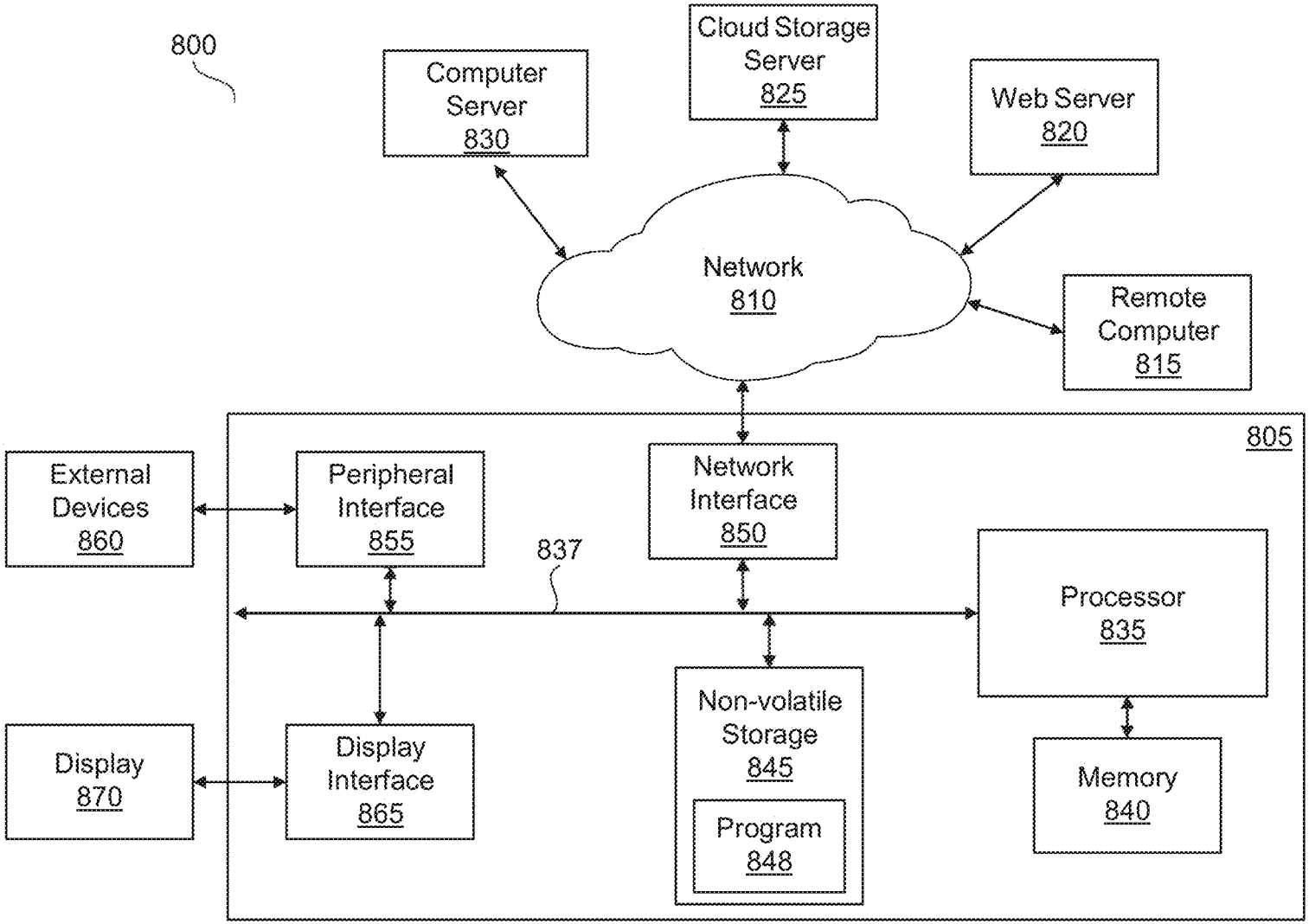
FIG. 7 is a diagram of a computer that may implement control operations described herein.

FIG. 7 illustrates a block diagram of a computer that may implement the various embodiments of the control unit 18 and memory unit 19, as described herein. The present disclosure may be embodied as a system, a method, and/or a computer program product. The computer program product may include a computer readable storage medium on which computer readable program instructions are recorded that may cause one or more processors to carry out aspects of the embodiment.

The computer readable storage medium may be a tangible device that can store instructions for use by an instruction execution device (processor). The computer readable storage medium may be, for example, but is not limited to, an electronic storage device, a magnetic storage device, an optical storage device, an electromagnetic storage device, a semiconductor storage device, or any appropriate combination of these devices. A non-exhaustive list of more specific examples of the computer readable storage medium includes each of the following (and appropriate combinations): flexible disk, hard disk, solid-state drive (SSD), random access memory (RAM), read-only memory (ROM), erasable programmable read-only memory (EPROM or Flash), static random access memory (SRAM), compact disc (CD or CD-ROM), digital versatile disk (DVD) and memory card or stick. A computer readable storage medium, as used in this disclosure, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described in this disclosure can be downloaded to an appropriate computing or processing device from a computer readable storage medium or to an external computer or external storage device via a global network (i.e., the Internet), a local area network, a wide area network and/or a wireless network. The network may include copper transmission wires, optical communication fibers, wireless transmission, routers, firewalls, switches, gateway computers and/or edge servers. A network adapter card or network interface in each computing or processing device may receive computer readable program instructions from the network and forward the computer readable program instructions for storage in a computer readable storage medium within the computing or processing device.

Computer readable program instructions for carrying out operations of the present disclosure may include machine language instructions and/or microcode, which may be compiled or interpreted from source code written in any combination of one or more programming languages, including assembly language, Basic, Fortran, Java, Python, R, C, C++, C# or similar programming languages. The computer readable program instructions may execute entirely on a user's personal computer, notebook computer, tablet, or smartphone, entirely on a remote computer or computer server, or any combination of these computing devices. The remote computer or computer server may be connected to the user's device or devices through a computer network, including a local area network or a wide area network, or a global network (i.e., the Internet). In some embodiments, electronic circuitry including, for example, programmable logic circuitry, field-programmable gate arrays (FPGA), or programmable logic arrays (PLA) may execute the computer readable program instructions by using information from the computer readable program instructions to configure or customize the electronic circuitry, in order to perform aspects of the present disclosure.

Aspects of the present disclosure are described herein with reference to flow diagrams and block diagrams of methods, apparatus (systems), and computer program products according to embodiments of the disclosure. It will be understood by those skilled in the art that each block of the flow diagrams and block diagrams, and combinations of blocks in the flow diagrams and block diagrams, can be implemented by computer readable program instructions.

The computer readable program instructions that may implement the systems and methods described in this disclosure may be provided to one or more processors (and/or one or more cores within a processor) of a general purpose computer, special purpose computer, or other programmable apparatus to produce a machine, such that the instructions, which execute via the processor of the computer or other programmable apparatus, create a system for implementing the functions specified in the flow diagrams and block diagrams in the present disclosure. These computer readable program instructions may also be stored in a computer readable storage medium that can direct a computer, a programmable apparatus, and/or other devices to function in a particular manner, such that the computer readable storage medium having stored instructions is an article of manufacture including instructions which implement aspects of the functions specified in the flow diagrams and block diagrams in the present disclosure.

The computer readable program instructions may also be loaded onto a computer, other programmable apparatus, or other device to cause a series of operational steps to be performed on the computer, other programmable apparatus or other device to produce a computer implemented process, such that the instructions which execute on the computer, other programmable apparatus, or other device implement the functions specified in the flow diagrams and block diagrams in the present disclosure.

FIG. 7 is a functional block diagram illustrating a networked system 800 of one or more networked computers and servers, any one of which, or combinations of which may be the control unit 18 (FIG. 3). In an embodiment, the hardware and software environment illustrated in FIG. 7 may provide an exemplary platform for implementation of the software and/or methods according to the present disclosure. Referring to FIG. 7, a networked system 80 may include, but is not limited to, computer 805, network 810, remote computer 815, web server 820, cloud storage server 825 and computer server 830. In some embodiments, multiple instances of one or more of the functional blocks illustrated in FIG. 7 may be employed.

Additional detail of computer 805 is shown in FIG. 7. The functional blocks illustrated within computer 805 are provided only to establish exemplary functionality and are not intended to be exhaustive. And while details are not provided for remote computer 815, web server 820, cloud storage server 825 and computer server 830, these other computers and devices may include similar functionality to that shown for computer 805. Computer 805 may be a personal computer (PC), a desktop computer, laptop computer, tablet computer, netbook computer, a personal digital assistant (PDA), a smart phone, or any other programmable electronic device capable of communicating with other devices on network 810.

Computer 805 may include processor 835, bus 837, memory 840, non-volatile storage 845, network interface 850, peripheral interface 855 and display interface 865. Each of these functions may be implemented, in some embodiments, as individual electronic subsystems (integrated circuit chip or combination of chips and associated devices), or, in other embodiments, some combination of functions may be implemented on a single chip (sometimes called a system on chip or SoC).

Processor 835 may be one or more single or multi-chip microprocessors, such as those designed and/or manufactured by Intel Corporation, Advanced Micro Devices, Inc. (AMD), Arm Holdings (Arm), Apple Computer, etc. Examples of microprocessors include Celeron, Pentium, Core i3, Core i5 and Core i7 from Intel Corporation; Opteron, Phenom, Athlon, Turion and Ryzen from AMD; and Cortex-A, Cortex-R and Cortex-M from Arm. Bus 837 may be a proprietary or industry standard high-speed parallel or serial peripheral interconnect bus, such as ISA, PCI, PCI Express (PCI-e), AGP, and the like. Memory 84) and non-volatile storage 845 may be computer-readable storage media. Memory 840 may include any suitable volatile storage devices such as Dynamic Random Access Memory (DRAM) and Static Random Access Memory (SRAM). Non-volatile storage 845 may include one or more of the following: flexible disk, hard disk, solid-state drive (SSD), read-only memory (ROM), erasable programmable read-only memory (EPROM or Flash), compact disc (CD or CD-ROM), digital versatile disk (DVD) and memory card or stick.

Program 848 may be a collection of machine readable instructions and/or data that is stored in non-volatile storage 845 and is used to create, manage, and control certain software functions that are discussed in detail elsewhere in the present disclosure and illustrated in the drawings. In some embodiments, memory 840 may be considerably faster than non-volatile storage 845. In such embodiments, program 848 may be transferred from non-volatile storage 845 to memory 840 prior to execution by processor 835.

Computer 805 may be capable of communicating and interacting with other computers via network 810 through network interface 850. Network 810 may be, for example, a local area network (LAN), a wide area network (WAN) such as the Internet, or a combination of the two, and may include wired, wireless, or fiber optic connections. In general, network 810 can be any combination of connections and protocols that support communications between two or more computers and related devices.

Peripheral interface 855 may allow for input and output of data with other devices that may be connected locally with computer 805. For example, peripheral interface 855 may provide a connection to external devices 860. External devices 860 may include devices such as a keyboard, a mouse, a keypad, a touch screen, and/or other suitable input devices. External devices 860 may also include portable computer-readable storage media such as, for example, thumb drives, portable optical or magnetic disks, and memory cards. Software and data used to practice embodiments of the present disclosure, for example, program 848, may be stored on such portable computer-readable storage media. In such embodiments, software may be loaded onto non-volatile storage 845 or, alternatively, directly into memory 840 via peripheral interface 855. Peripheral interface 855 may use an industry standard connection, such as RS-232 or Universal Serial Bus (USB), to connect with external devices 860.

Display interface 865 may connect computer 805 to display 870. Display 870 may be used, in some embodiments, to present a command line or graphical user interface to a user of computer 805. Display interface 865 may connect to display 870 using one or more proprietary or industry standard connections, such as VGA, DVI, DisplayPort and HDMI.

As described above, network interface 850, provides for communications with other computing and storage systems or devices external to computer 805. Software programs and data discussed herein may be downloaded from, for example, remote computer 815, web server 820, cloud storage server 825 and computer server 830 to non-volatile storage 845 through network interface 850 and network 810. Furthermore, the systems and methods described in this disclosure may be executed by one or more computers connected to computer 805 through network interface 850 and network 810. For example, in some embodiments the systems and methods described in this disclosure may be executed by remote computer 815, computer server 830, or a combination of the interconnected computers on network 810.

Data, datasets and/or databases employed in embodiments of the systems and methods described in this disclosure may be stored and or downloaded from remote computer 815, web server 820, cloud storage server 825 and computer server 830.

INDUSTRIAL APPLICABILITY

The present disclosure is suitable for a sheet processing machine for treating sheets such as banknotes.

REFERENCE SIGNS LIST

1 Banknote processing machine
10 Processing unit
11 Upper housing
12 Depositing unit
13 Dispensing unit
14 Second dispensing unit
15 Transport unit
150 Loop-shaped transport path
151 First diverter path
152 Second diverter path
153 Third diverter path
154 Fourth diverter path
155 Fifth diverter path
15*a* Transport unit side action point
16 Recognition unit
17 Temporary storage
18 Control unit
19 Memory unit
20 Storage
21 Lower housing
22 Stacking type storage
23 Winding type storage
40 Banknote storage unit
40*a* Storage side action point
41 Reel
42 Drum
43, 43*a*, 43*b* Tape
44 First stepper motor
45 Second stepper motor
46 Winding body
48 Tape movement detector

The invention claimed is:

1. A sheet processing machine for storing sheets transported by a transport unit, the sheet processing machine comprising:

a reel on which a first end side of a tape is wound;

a first stepper motor that rotates the reel about a rotation axis of the reel;

a drum configured to wind up a second end side of the tape together with the sheets to form a winding body together with the tape and the sheets;

a second stepper motor that rotates the drum about a rotation axis of the drum;

a movement detector that detects a movement amount of the tape between the reel and the drum; and circuitry configured to obtain a length of the tape wound on the drum based on the movement amount of the tape detected by the movement detector, and calculate a diameter or a radius of the winding body based on a rotation angle of the drum and the length of the tape wound on the drum.

2. The sheet processing machine according to claim 1, wherein the circuitry is further configured to obtain the rotation angle of the drum based on a number of operation steps of the second stepper motor.

3. The sheet processing machine according to claim 1, wherein the circuitry is further configured to control rotation of the first stepper motor and the second stepper motor based on the diameter or the radius of the winding body.

4. The sheet processing machine according to claim 1, wherein the circuitry is further configured to calculate a diameter or a radius of a cylindrical body formed by the tape wound on the reel based on a rotation angle of the reel and a feeding length of the tape from on the reel.

5. A sheet processing machine for storing sheets transported by a transport unit, the sheet processing machine comprising:

a reel on which a first end side of a tape is wound;

a first stepper motor that rotates the reel about a rotation axis of the reel;

a drum configured to wind up a second end side of the tape together with the sheets to form a winding body together with the tape and the sheets;

a second stepper motor that rotates the drum about a rotation axis of the drum; and circuitry configured to calculate a diameter or a radius of the winding body, based on a rotation angle of the drum and a length of the tape wound on the drum, in each of two states where the rotation angles of the drum are different from each other, and determine that there is an abnormality, under a condition that a difference between the diameters or the radii of the winding body in the two states exceeds a predetermined range.

6. The sheet processing machine according to claim 5, wherein the circuitry is further configured to obtain the rotation angle of the drum based on a number of operation steps of the second stepper motor.

7. The sheet processing machine according to claim 5, wherein the circuitry is further configured to control rotation of the first stepper motor and the second stepper motor based on the diameter or the radius of the winding body.

8. A sheet processing machine for storing sheets transported by a transport unit, the sheet processing machine comprising:

a reel on which a first end side of a tape is wound;

a first stepper motor that rotates the reel about a rotation axis of the reel;

a drum configured to wind up a second end side of the tape together with the sheets to form a winding body together with the tape and the sheets;

a second stepper motor that rotates the drum about a rotation axis of the drum; and circuitry configured to calculate a diameter or a radius of the winding body based on a rotation angle of the drum and a length of the tape wound on the drum, calculate a diameter or a radius of a cylindrical body formed by the tape wound on the reel based on a rotation angle of the reel and a feeding length of the tape from on the reel, and calculate a length of the tape wound on the reel based on a diameter or a radius of the reel, the diameter or the radius of the cylindrical body, and a thickness of the tape.

9. The sheet processing machine according to claim 8, wherein the circuitry is further configured to obtain the rotation angle of the drum based on a number of operation steps of the second stepper motor.

10. The sheet processing machine according to claim 8, wherein the circuitry is further configured to control rotation of the first stepper motor and the second stepper motor based on the diameter or the radius of the winding body.

11. A sheet processing machine for storing sheets transported by a transport unit, the sheet processing machine comprising:

a reel on which a first end side of a tape is wound;

a first stepper motor that rotates the reel about a rotation axis of the reel;

a drum configured to wind up a second end side of the tape together with the sheets to form a winding body together with the tape and the sheets;

a second stepper motor that rotates the drum about a rotation axis of the drum; and circuitry configured to calculate a diameter or a radius of the winding body based on a rotation angle of the drum and a length of the tape wound on the drum, and verify a validity of the diameter or the radius of the winding body.

12. The sheet processing machine according to claim 11, wherein the circuitry is further configured to detect an abnormality of the sheet processing machine by verifying the validity of the diameter or the radius of the winding body.

13. The sheet processing machine according to claim 11, wherein the circuitry is further configured to calculate a theoretical value of the diameter or the radius of the winding body based on a number and a type of the wound sheets and a set interval between the sheets;

verify the validity by comparing the diameter or a radius of the winding body based on the rotation angle of the drum and the length of the tape wound on the drum with the theoretical value.

14. The sheet processing machine according to claim 11, wherein the circuitry is further configured to obtain the rotation angle of the drum based on a number of operation steps of the second stepper motor.

15. The sheet processing machine according to claim 11, wherein the circuitry is further configured to control rotation of the first stepper motor and the second stepper motor based on the diameter or the radius of the winding body.

* * * * *